United States Patent [19]

Brown et al.

[11] Patent Number: 4,909,336

[45] Date of Patent: Mar. 20, 1990

[54] DRILL STEERING IN HIGH MAGNETIC INTERFERENCE AREAS

[75] Inventors: David C. Brown, Los Osos; Fred L. Watson, Templeton, both of Calif.

[73] Assignee: Applied Navigation Devices, San Luis Obispo, Calif.

[21] Appl. No.: 250,361

[22] Filed: Sep. 29, 1988

[51] Int. Cl.[4] ..... E21B 47/022; E21B 47/12; G01C 19/38

[52] U.S. Cl. ..... 175/45; 33/304; 175/61

[58] Field of Search ..... 175/26, 45, 75, 73, 175/27, 61, 107; 73/151; 364/420; 33/302, 304

[56] References Cited

U.S. PATENT DOCUMENTS

| | | | |
|---|---|---|---|
| 2,309,905 | 2/1943 | Irwin et al. . | |
| 2,635,349 | 4/1953 | Green . | |
| 2,674,049 | 4/1954 | Janes, Jr. . | |
| 2,681,567 | 6/1954 | Widess . | |
| 2,806,295 | 9/1957 | Ball . | |
| 3,037,295 | 6/1962 | Robertson . | |
| 3,052,129 | 9/1962 | Rocks . | |
| 3,137,077 | 6/1964 | Rosenthal . | |
| 3,224,513 | 12/1965 | Weeden, Jr. | 175/45 X |
| 3,241,363 | 3/1966 | Alderson et al. . | |
| 3,308,670 | 3/1967 | Granqvist . | |
| 3,561,129 | 2/1971 | Johnston . | |
| 3,753,296 | 8/1973 | Van Steenwyk . | |
| 3,894,341 | 7/1975 | Kapeller . | |
| 4,293,046 | 10/1981 | Van Steenwyk . | |
| 4,297,790 | 11/1981 | Van Steenwyk . | |
| 4,317,493 | 3/1982 | Thompson | 175/45 X |
| 4,433,491 | 2/1984 | Ott et al. . | |
| 4,445,578 | 5/1984 | Millheim | 175/45 |
| 4,459,760 | 7/1984 | Watson et al. . | |
| 4,468,863 | 9/1984 | Van Steenwyk | 33/304 |
| 4,542,647 | 9/1985 | Molnar | 175/45 X |
| 4,559,713 | 12/1985 | Ott et al. | 33/304 X |
| 4,577,701 | 3/1986 | Dellinger | 175/61 |
| 4,611,405 | 9/1986 | Van Steenwyk | 33/304 |
| 4,637,480 | 1/1987 | Obrecht et al. | 175/61 X |
| 4,662,458 | 5/1987 | Ho | 175/45 X |
| 4,706,388 | 11/1987 | Van Steenwyk | 33/304 |
| 4,739,841 | 4/1988 | Das | 175/45 X |

*Primary Examiner*—Stephen J. Novosad
*Attorney, Agent, or Firm*—William W. Haefliger

[57] ABSTRACT

A method for steering the direction of drilling for oil, gas, or other boreholes drilled in locations such that the level of magnetic interference from nearby magnetic materials or fields is so large that conventional methods using magnetic compass steering tools cannot meet required accuracies. The method is based upon using gyroscope-based survey tools having an inertial angular rate sensor with one or more axes of rate sensitivity and an inertial acceleration or tilt sensor with one or more axes of sensitivity to perform both the normal survey purpose for such tools and the steering function during drilling.

The method includes the measurement of initial azimuthal direction, tilt angle, gyro tool face and high side tool face at the beginning of the borehole and the continuous measurement of one or more of these quantities as drilling progresses.

21 Claims, 6 Drawing Sheets

GEOMETRY OF MEASURMENTS

GEOMETRY OF MEASURMENTS

DRILL STEERING IN HIGH MAGNETIC INTERFERENCE AREAS

BACKGROUND OF THE INVENTION

In the drilling of oil, gas, and other types of wells in congested regions where there are numerous other existing wells, it is often necessary to have precise control of the path of the well being drilled to avoid other wells and to achieve the desired trajectory of the well bore in underground space. This control has generally been achieved in the past by periodic surveys of the well bore path in space using either magnetic-based or gyroscope-based surveying tools and steering of the drill path during drilling based on steering tools that sense the earth's gravity and magnetic fields. Typical of the magnetic field sensing steering tools is the Electronic Yaw Equipment (EYE) provided by Scientific Drilling International that is based on U.S. Pat. No. 3,791,043 "Indicating Instruments", and U.K. Patent 1240830 "Improvements In Or Relating To Indicating Instruments". This steering tool provides two magnetic field sensors and two acceleration or tilt sensors, all of which have their respective sensitive axes normal to the borehole axis in use.

The density of wells on offshore platforms or in localized drilling areas ashore has increased to the point where there may be many wells in close proximity to each other. It is often desired to drill a new well within two to five feet of other existing wells. The new well must be guided as it is drilled to maintain separation from existing wells and to achieve the desired trajectory in space. The magnetic fields caused by iron-based magnetic materials in adjacent well casings, platform structures, and other drilling apparatus are sufficient to cause large and unacceptable errors in the output of magnetic-based survey and steering tools. To date, this problem has been approached by using gyroscope-based survey tools to frequently survey the borehole path and magnetic-based steering tools to steer the well direction during drilling for short segments between such surveys. Such surveys are known as "single shot" gyroscope surveys. The gyroscope-based survey tools that have conventionally been used for these surveys are of the free directional gyroscope type that are not sufficiently rugged to remain in the hole for steering during subsequent drilling. Therefore, they must be withdrawn from the borehole before drilling is begun on each segment. Thus with previous methods, the direction of drilling for each segment is uncontrolled and very frequent stops must be made for repeated "single shot" surveys and short segments of blind drilling.

In borehole surveying and steering, the quantities usually used to describe the geometry of the problem are the azimuthal direction of the borehole with respect to either true or magnetic North, the tilt or inclination of the borehole with respect to the earth's gravity vector, the azimuthal tool face angle of the drilling apparatus, and the high side tool face angle of the drilling apparatus. These latter two quantities are measurements of the direction of a reference vector perpendicular to the borehole direction through a reference slot on the drilling apparatus. This slot is often referred to as a "muleshoe", a name derived from the shape of the slot. The azimuthal tool face is defined as the direction, with respect to North (either magnetic or true), of the horizontal projection of the reference vector. The high side tool face is defined as the rotation angle about the borehole axis from a vertical plane containing the borehole axis to the reference vector.

New gyroscope-based survey tools using inertial angular rate sensors rather than the older free-gyroscope direction reference approach provide improvements in surveying accuracy, speed, and flexibility. U.S. Pat. No. 3,753,296, "Well Mapping Apparatus and Method", U.S. Pat. No. 4,199,869, "Mapping Apparatus Employing Two Input Axis Gyroscopic Means", and U.S. Pat. No. 4,706,388, "Borehole Initial Alignment and Change Determination", are typical of such survey tools. Also U.S. Pat. Nos. 4,468, 863 and 4,611,405, both entitled "High Speed Surveying", described methods of using such inertial angular rate sensing survey tools. Since these new survey tools use inertial angular rate sensors rather than free directional gyroscopes they can be built to withstand the severe vibration environment during drilling and thus be used to steer the drilling process by providing measurements of azimuth, inclination, azimuthal tool face, and high side angle to the drilling operator.

SUMMARY OF THE INVENTION

It is a first objective of this invention to provide a method of using gyroscope-based inertial angular rate measuring survey tools to both survey and continuously steer the direction of forming a well bore during drilling.

It is a further objective to provide a steering method for drilling boreholes that is not sensitive to magnetic field errors caused by nearby magnetic materials in structures or other wells so that higher accuracies can be achieved under such conditions.

Also, it is further objective to provide a faster and less costly method for surveying and steering during drilling of boreholes in adverse magnetic interference areas than has previously been available using periodic "single sho" gyroscope surveys and no steering equipment between surveys.

Typically, the steering method of the invention uses a gyroscope-based survey tool having an inertial angular rate sensor and an inertial acceleration sensor, both of which may have one or more sensing axes, attached to the drilling assembly and placed in the starting area of a borehole to be drilled. Communication from the gyroscope-based tool to the surface-readout equipment may be by means of the well-known side-entry subassembly for wireline usage or the equally well-known mud-pulse communication methods. Either of these will permit drill pipe sections to be added to the drill string as the drill penetrates into the earth without pulling the gyroscope-based tool from the hole as each pipe section is added. These types of communication are the preferred approaches but are not necessary to the invention as described below.

During initial drilling, the gyroscope-based tool is operated continuously in its cyclical measurement mode to provide outputs of gyro tool face and high side tool face. In the vertical portion of the hole at the start, azimuthal direction of the borehole is undefined and therefore cannot be measured. Both the gyro tool face and the high side tool face indications are valid and provide indications to the driller as to how to control the drilling and how to guide the drill bit in the desired direction. As the drilling progresses, the continuous cyclical measurement mode of the gyroscope-based tool will also afford a measure of the azimuthal direction and inclination of the borehole as borehole formation is steered in the desired direction away from the initial vertical orientation. Improved survey accuracy in these measurements can be achieved by observing the measured data during periods that drilling is stopped for addition of new segments of drill pipe as the depth increases.

When the inclination angle of the borehole has reached about five degrees, another mode is available for those gyroscope-based tools that can operate in a high speed survey mode. For such tools, the sensors may be stabilized to null the output of one of the inertial acceleration axes of sensing. In this mode a continuous indication of high side tool face is available from a resolver on the sensor rotation axis.

In this mode, the gyroscope-based tool can also measure azimuthal changes in the direction of the borehole as drilling progresses and such measurements may be cyclically repeated as each new segment of drill pipe is added to the drill string. In this method, the advantages of such "high speed surveying" tools in avoiding errors of the gyrocompass mode of surveying can be extended to the steering of drilling so that accurate survey data is obtained in real time without the need for periodic surveying by other equipment.

Alternatively, in "high speed survey" tools having capabilities for stabilization of the sensors to references other than a single acceleration sensor, the sensors may be stabilized to any desired orientation using the outputs to two acceleration sensors, a resolver on the sensor stabilization axis, and/or a inertial angular rate sensor axis of sensitivity along the borehole axis in various combinations as appropriate.

These and other objects and advantages of the invention, as well as the details of an illustrative embodiment, will be more fully understood from the following specification and drawings, in which:

DRAWING DESCRIPTION

Figure 3:
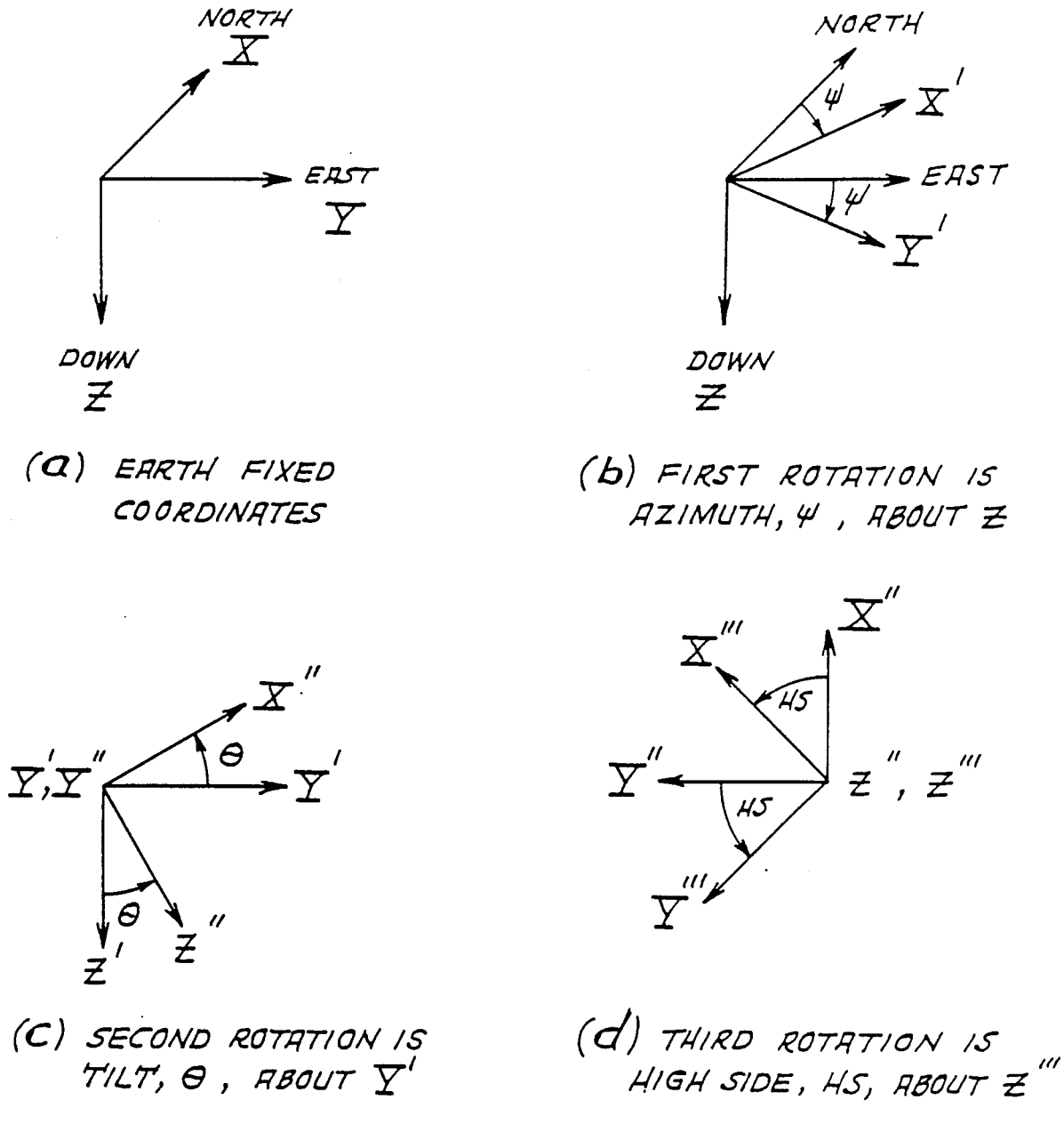
Figure 4:
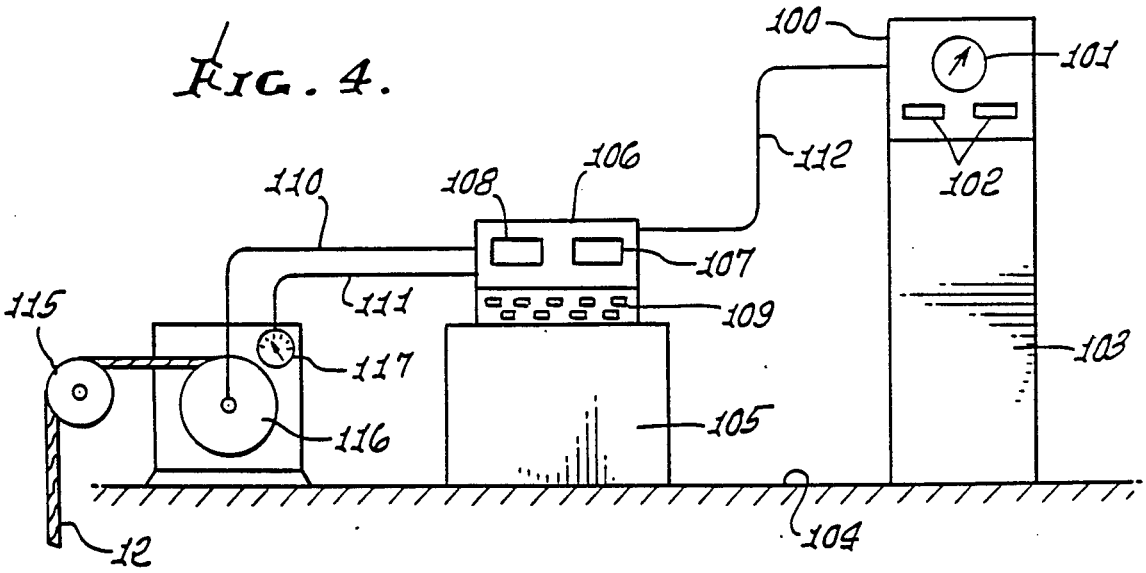
Figure 7:
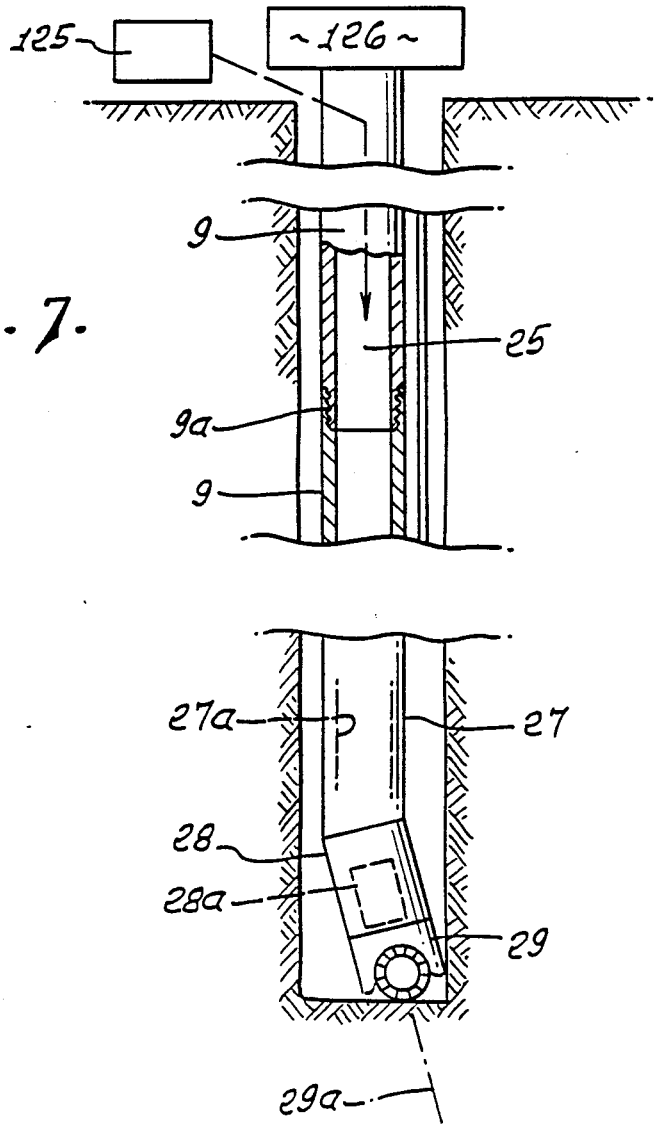
Figure 5A:
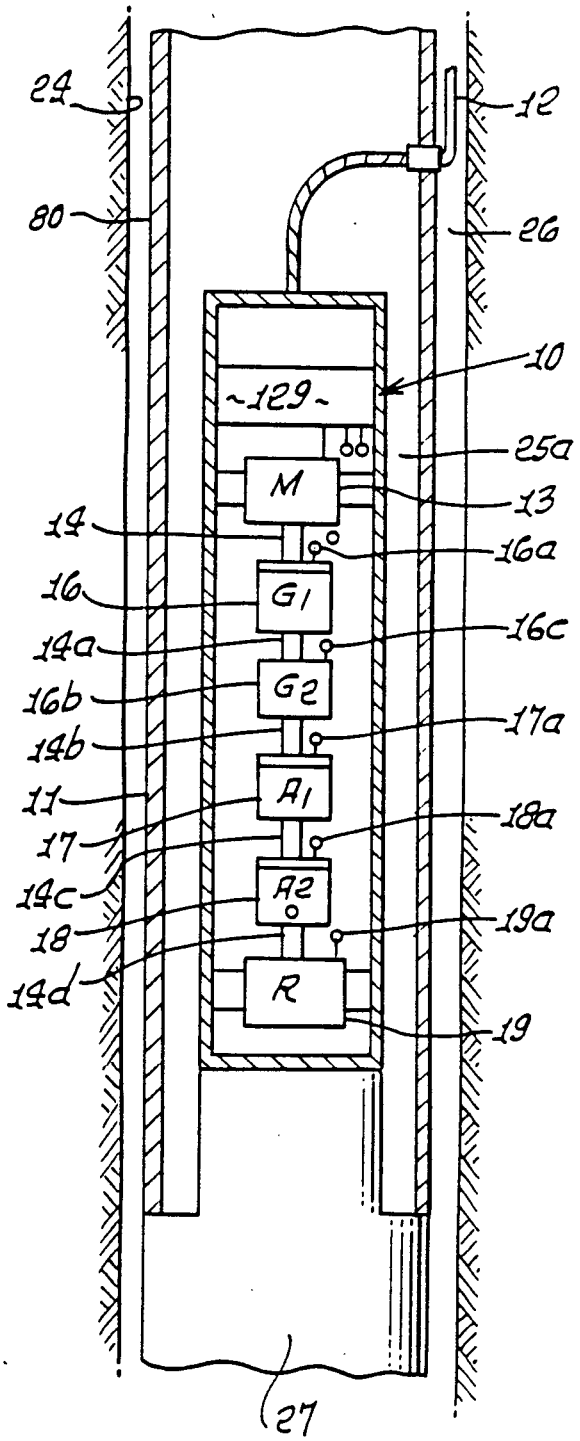
Figure 5B:
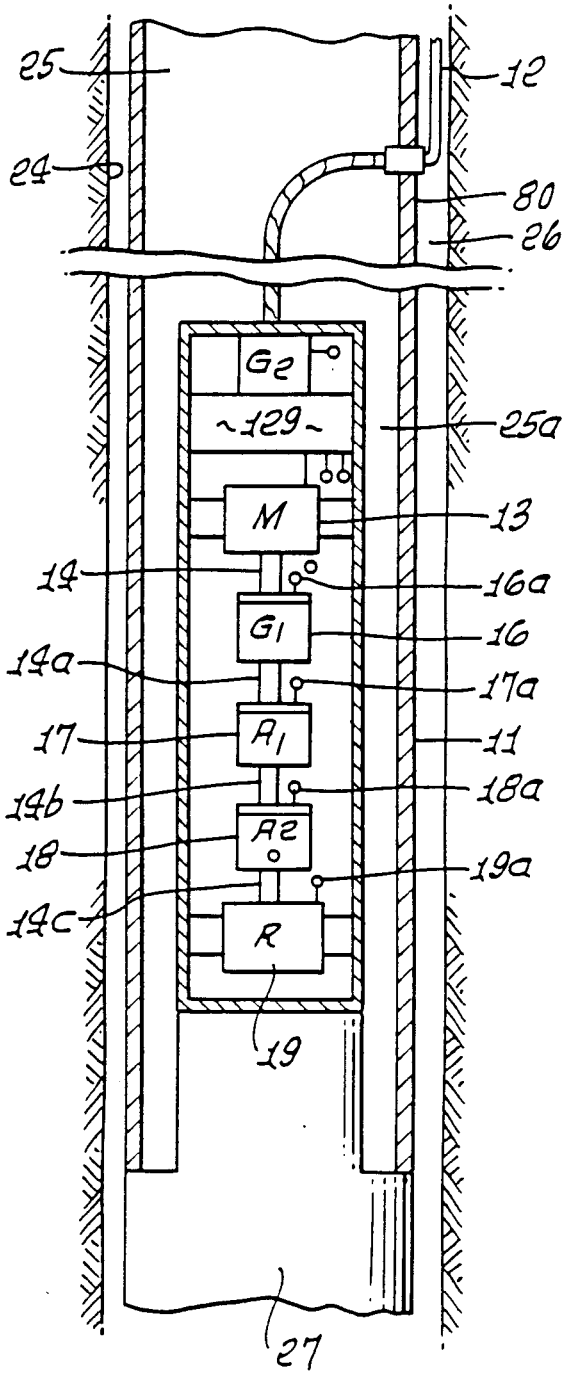
Figure 6:
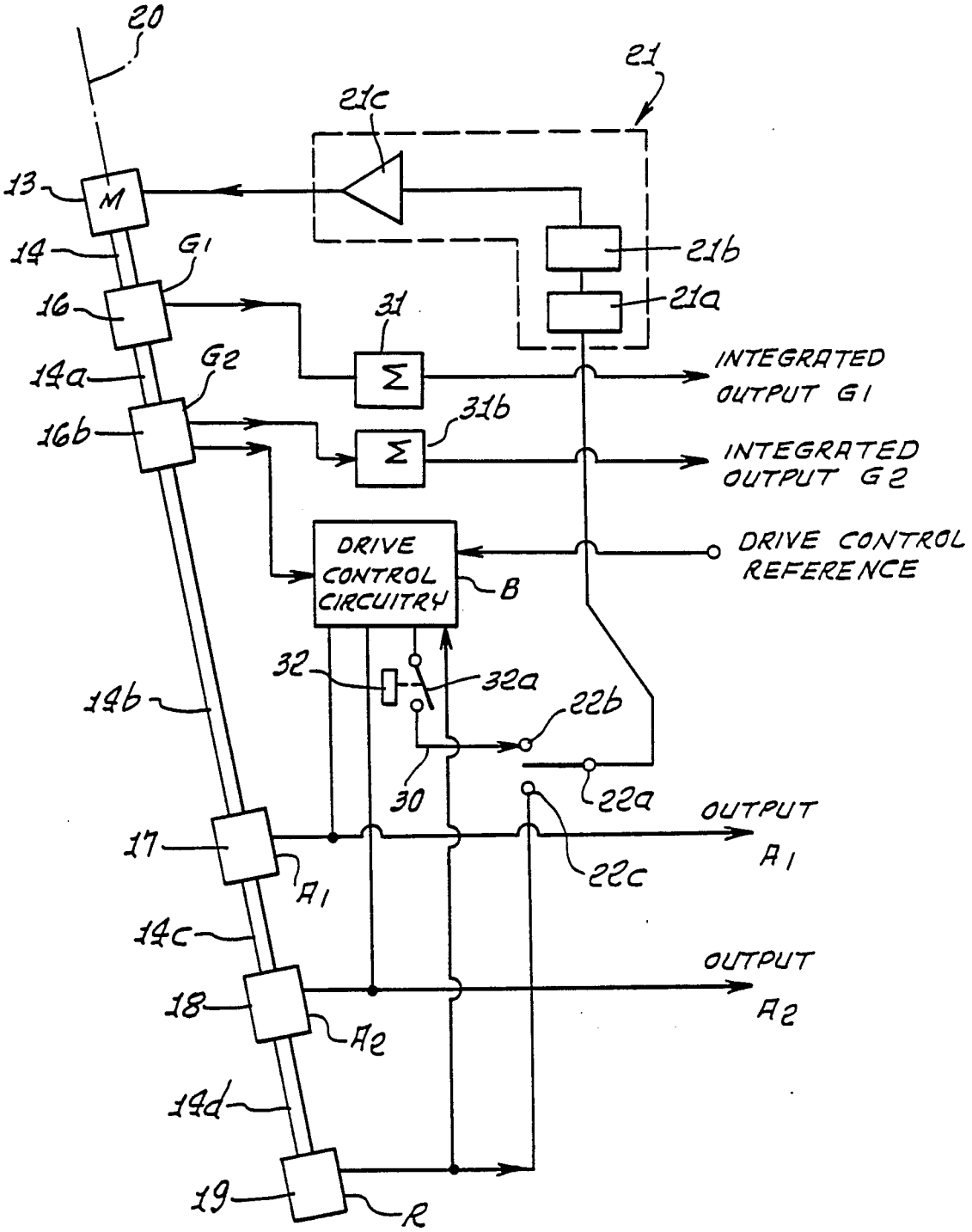

FIG. 3 views 3(*a*)–3(*d*) are geometrical depictions of the reference axes, defined reference vectors and defined angular reference used in surveying and steering operations;

FIG. 4 shows in elevation the general arrangement of equipment for steering and readout of data to the driller that is employed on the surface during well bore steering and survey operations;

FIG. 5*a* is a cross section in elevation of one typical high speed surveying tool usable for well bore steering as well as surveying;

FIG. 5*b* is a cross section in elevation of another typical high speed surveying tool;

FIG. 6 is a block diagram showing certain control loops for typical high speed survey tools; and FIG. 7 shows additional equipment.

DETAILED DESCRIPTION

Figure 1:
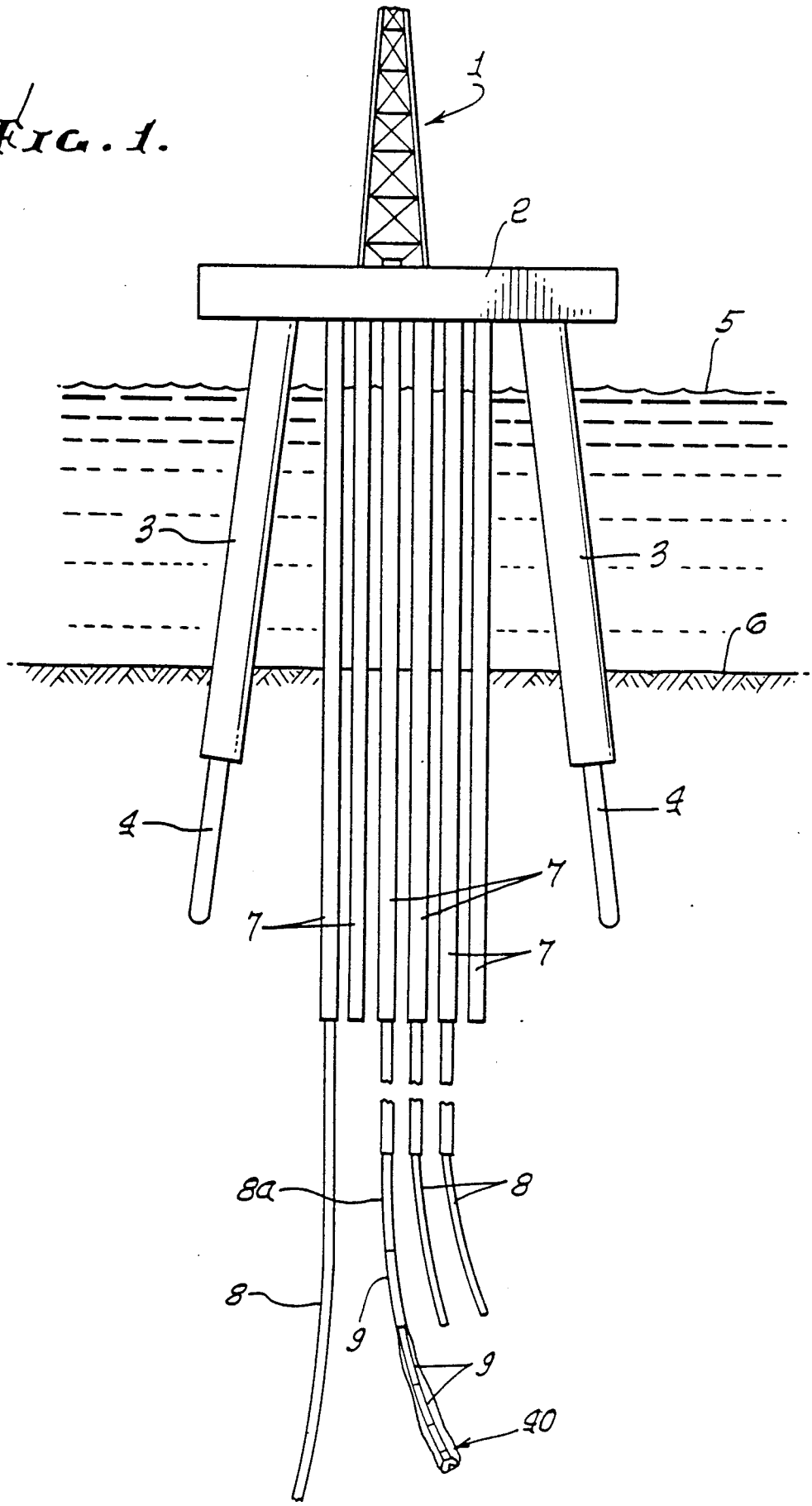
FIG. 1 shows in elevation an offshore platform with multiple sources of magnetic interference from which a new borehole is to be drilled.

FIG. 1 shows a drilling rig 1 on a platform 2 that is mounted by legs and piling 3, 4 into and onto the sea floor 6. The sea water level 5 is shown for reference and to indicate that this is an offshore drilling platform. Several cased holes 7 are shown drilled and cased to some initial depth from which inclined cased wells 8 have been completed. Shown at 8*a* is a hole being drilled in the formation by a bottom hole assembly 40 that is being operated by the flow of drilling mud being pumped down to the bottom hole assembly from the drilling rig through sections of drill pipe 9. Almost all of the materials shown in FIG. 1 are iron-based metal that may have significant magnetic permeability which will distort the earth's magnetic field in the drilling area and that may have residual magnetic fields which will add further to measurement errors if magnetometer-based sensors are used to measure and control the direction of progression of the drilling process. In starting a new borehole from the surface, the region of the sections 7 must be traversed to the beginnings of the well regions 8 proximate which the new borehole will begin to deviate in azimuth and inclination toward the desired target area. Distances of the new borehole from significant magnetic materials may be as small as two feet in these regions and magnetic field errors can easily exceed several degrees in equivalent direction indications. Thus, severe position errors with respect to the desired borehole trajectory can be expected. This leads to significant risks of intersection with nearby boreholes which could have very costly and unfortunate consequences.

Figure 2:
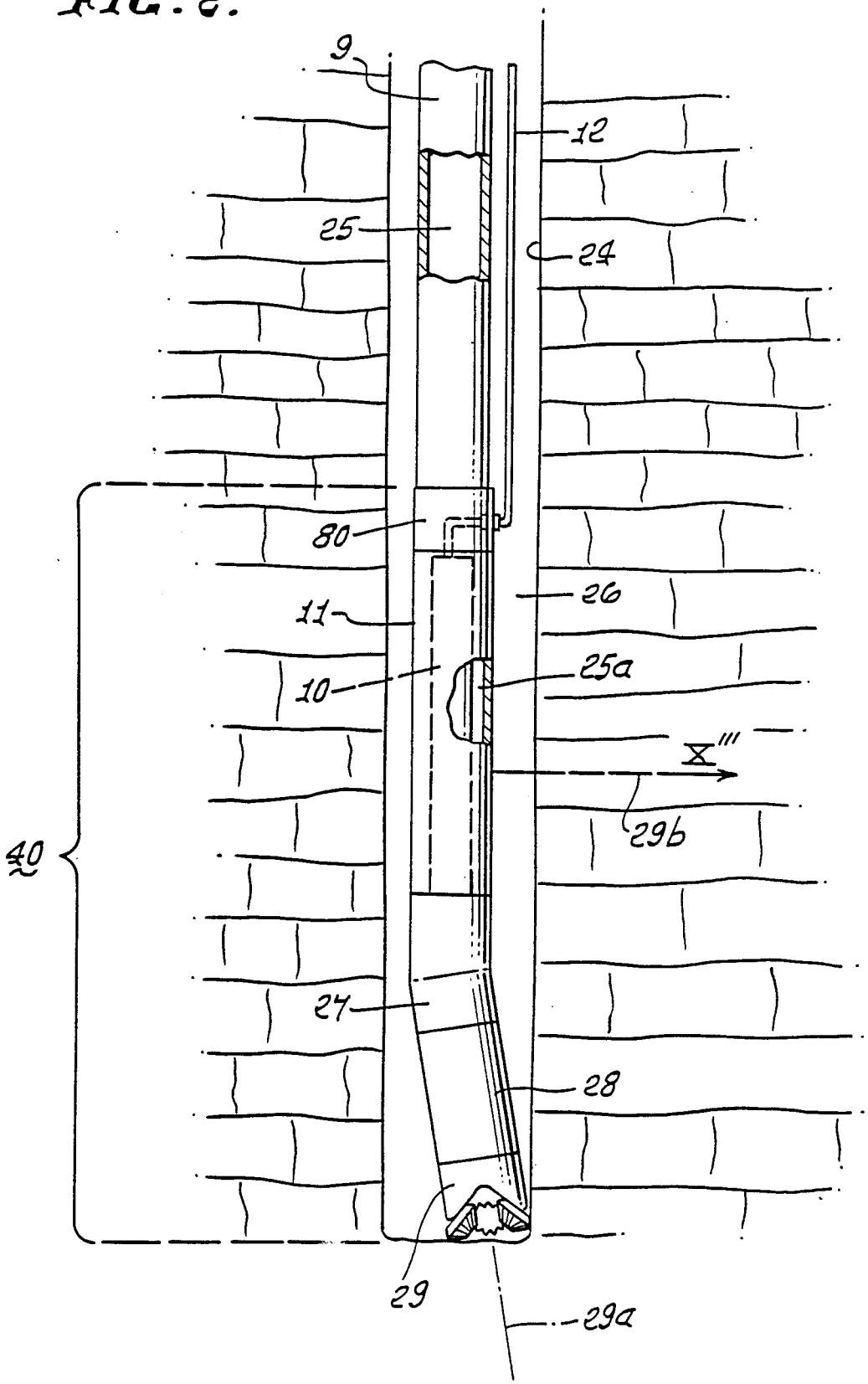
FIG. 2 is an elevation in an underground formation, showing a typical bottom hole assembly for drilling and steering a well bore.

FIG. 2 shows details of the bottom hole assembly 40 indicated in FIG. 1. The assembly 40 is shown attached to drill pipe segment 9 in the borehole 24. The bottom hole assembly comprises a drill collar 11, a bent sub or subassembly 27, and a mud motor in unit 28 for driving the rotary drill 29 about axis 29*a*. Within the drill collar is a gyroscope-based survey tool 10 having inertial angular rate sensor means which will be described later. The mud motor that drives the rotary drill is driven by drilling mud flow pumped from the surface downwardly through the hollow interior 25 of the drill pipe 9 and through an annular space 25*a* within 11 and around the survey tool 10. Mud also flows through sub 28 to the motor in unit 28.

The mud flow returns to the surface in the annular space or annulus 26 between the outside of the drill collar/drill pipe and the borehole wall 24. A wireline 12 that is internally connected to the survey tool 10 is shown exiting the side of the drill collar through a well known "side entry" subassembly indicated at 80. The wireline then runs to the surface in the same annular space 26 which carries the return mud flow from the mud motor. The bend angle of the bent subassembly 27 is selected based on the desired rate to change in direction vs. distance. Angles in the range of one half to three degrees may be considered typical. A reference direction vector, X''', 29*b* is shown that lines in the upright plane formed by the bent subassembly, i.e. axis 29*a*. It is well known in directional drilling that steering the direction of deviation of the borehole is achieved by rotating the entire drill string including the bottom hole assembly until a reference vector in the plane of the bent subassembly points in the desired direction. When it is pointed in the desired direction, the weight of the drill string on the bit causes the bit to deviate in direction along this reference direction. Thus the process of steering the bit along the desired trajectory is seen to be one of measuring the direction of the reference vector 29, displaying this measurement to the driller, and adjustment by the driller of the orientation of the bottom hole assembly as necessary.

FIG. 3 shows how the reference vector 29b is defined in relation to the earth-fixed coordinate used for well planning, drill steering, and surveying the borehole trajectory in space. At (a) an isometric view of the three reference directions North, East, and Down is shown. These directions are labeled X, Y, and Z respectively. At (b) the same reference directions are shown and the influence of a rotation angle, $\psi$ (psi), about Z on the original X and Y vectors is shown. The angle, $\psi$ (psi), is by definition, the azimuthal direction of the borehole, and the resulting new axes are labeled X' and Y'. Z is unchanged in direction by the azimuthal rotation but it is labeled Z' for consistency. Note that the azimuthal North reference is generally magnetic North for magnetic measurements and true North for gyroscope-based measurements. At (c) a view is shown looking along the direction of the Y' vector at (b). A further rotation, $\theta$ (theta), is shown about the Y' vector. This rotation is defined as the tilt or inclination angle for the borehole since the Y' axis is true horizontal in this view. The resulting axes are labeled X'', Y'', and Z''. Note that the Z'' axis is still along the borehole axis. Lastly, at (d) a view is shown along the Z'' or borehole axis. The influence of the final rotation, HS (high side), is shown. The vector X''' is normal to the borehole direction and the plane of the bend in the bent subassembly (27 in FIG. 2) is by definition installed in this direction. The vector X''' in FIG. 3(*d*) is thus the same as the reference direction vector X''' 29b shown in FIG. 2.

One other reference angle must be defined. The high side angle HS described above is generally referred to as the "high side tool face". Another tool face term is used that represents the angle between the North reference direction and the horizontal projection of the vector X''' shown above to a horizontal plane. This angle is generally referred to as magnetic tool face when magnetic measurements are made and gyro tool face when gyroscope-based measurements are made. For general use independent of measurement type, the term azimuthal tool face will be used and abbreviated as ATF.

The value of ATF may be computed from the azimuth, inclination, and high side angles defined above as follows:

The direction cosine relating the reference vector X''' to the earth-fixed North vector X is given by, $$\text{Cos}(\psi)^* \text{Cos}(HS)^* \text{Cos}(\theta) - \text{Sin}(\psi)^* \text{Sin}(HS)$$

and the direction cosine relating X''' to the earth-fixed East vector Y is given by, $$\text{Sin}(\psi)^* \text{Cos}(HS)^* \text{Cos}(\theta) + \text{Cos}(\psi)^* \text{Sin}(HS)$$

Since the azimuthal tool face angle is defined as the angle between the North vector and the horizontal projection of the reference vector X''', the azimuthal tool face (ATF) angle may be computed as, $$ATF = \text{ARCTAN}\left(\frac{[\text{Sin}(\psi)^*\text{Cos}(HS)^*\text{Cos}(\theta) + \text{Cos}(\psi)^*\text{Sin}(HS)]}{[\text{Cos}(\psi)^*\text{Cos}(HS)^*\text{Cos}(\theta) - \text{Sin}(\psi)^*\text{Sin}(HS)]}\right)$$

and for small inclination angles $\theta$ (theta) where the Cos ($\theta$) may be approximated at 1.0 this may be reduced to the well known approximation, $$ATF = \psi + HS$$

which approximates the azimuthal tool face angle as the sum of the azimuthal direction of tilt of the borehole plus the high side rotation angle about the borehole axis. In the following discussions of steering using gyroscope-based surveying too, the azimuthal tool face will be referred to as gyro tool face or GTF and the high side angle HS will be referred to as high side or high side tool face.

FIG. 4 shows elements of equipment installed on the drilling rig for use in steering the drilling path and surveying the trajectory in space. The primary equipment includes a driller's display unit 100 mounted from the rig structure 104 by mounting structure 103. The mounting structure and display location are chosen to permit easy visibility by the driller, since he uses this display to view the instantaneous direction of drilling and the response of such direction of his control inputs. The display will typically include a primary pointer type display 101 usually displaying high side angle and sometimes displaying azimuthal tool face. Auxiliary display elements such as shown at 102 may be provided for the display of other relevant data for the steering process. Sensor data from the down-hole steering tool arrives at the surface on wireline 12 which passes over pulley 115 and is coiled on drum 116. The data leaves the drum at lead 110 and is transmitted to a data processing device 106 that is supported by mount 105 from the rig structure 104. The wireline drum may have an indicator 117 which shows the length of wireline in the borehole. Also, a signal is transmitted by path 111 to the data processing device to indicate the amount of wireline in the borehole. The data processing device 106 contains the necessary input/output circuitry to interface to leads 110 from the downhole equipment, 111 from the wireline and 112 to the driller's display. It also contains the computational capability, usually as digital computing elements, that is required to derive steering and survey data from sensor inputs. The data processing device further may contain a visual display 107 for the operator, a permanent recording device 108 such as a data printer, and a keyboard input device 109. The data processing device may comprise one or more physical packages to contain the functions identified. The data processing device is the principal means for operation and control of the downhole measuring equipment. The driller's display is the primary driller interface. The driller uses this display to determine how he should rotate the total drill string to proceed in drilling in the desired direction.

FIGS. 5(*a*) and 5(*b*) show typical gyroscope-based high speed surveying tools mounted down hole to the bent subassembly and surrounded by the drill collar as previously shown in FIG. 2. These figures are representative of apparatus as described and claimed in U.S. Pat. No. 4,706,388, "Borehole Initial Alignment and Change Determination". In FIG. 5(*a*) the downhole sensor assembly 10, i.e. survey tool, is contained within a drill collar 11 and connected at the hole bottom to bent subassembly 27. Drilling mud flows downwardly in the annulus 25a and on through the bent subassembly to the mud motor (not shown here) below. Mud flow returns upwardly in the annulus 26 between the drill collar and the wall of the borehole 24. A wireline 12 exits the top end of the sensor assembly and exits the side wall of the drilling collar through a side entry or side access subassembly 80 to continue to the surface in annulus 26.

Wireline 12 is electrically connected to elements within 10, described below. Note that with the wireline in annulus 26, additional segments of drill pipe can be added to the drill string without requiring breaking of the wireline connection or withdrawing the wireline/-sensor package from its downhole location. Wireline 12, in annulus 26, is typically protectively housed, as within a KEVLAR, or other suitable shroud. Inside the sensor assembly there are inertial angular rate sensing means G1 and G2, 16 and 16*b*, having outputs shown at 16*a* and 16*c*. Also, there are inertial acceleration or tilt sensing means A1 and A2, 17 and 18 having outputs shown at 17*a* and 18*a*. These sensing means are mounted together on structure represented as the shaft 14, 14*a*, 14*b*, 14*c*, and 14*d* which is supported at one end for rotation by motor M, 13, and at the other end by rotation angle sensor R, 19, having an output at 19*a*. Electronic circuitry shown at 129 and connected to 16*a*, 16*c*, 17*a*, 18*a* and 19*a* provides the necessary functions to control the sensing means, control the rotary drive comprising the sensing means and the motor, and provide communication interfaces to the wireline. FIG. 5(*b*) is substantially identical to FIG. 5(*a*) except that the inertial angular rate sensing G2 is located, as shown, fixed to the outer structure of the sensor assembly, rather than on the rotating element 14 through 14*d* of FIG. 5(*a*). A representative high speed surveying tool of the type described herein is the FINDER tool manufactured by Applied Navigation Devices, Inc., San Marino, Calif.

FIG. 6 shows a block diagram of the control loops for a typical high speed survey tool of the form shown in FIG. 5. The elements of the rotary drive along the indicated borehole axis 20 are as defined previously in the description of FIG. 5. The principal control elements are the motor drive circuitry 21 that comprises a preamplifier 21*a*, a compensation circuit 21*b*, and a power amplifier 21*c* to drive the motor 13, the integrator circuitry 31 and 31*b* that provide for integration of the angular rate sensor outputs, and the drive control circuitry B. The input to the motor drive circuitry at 22*a* may be selected from either 22*b* or 22*c* by the switch indicated. When the input 22*a* is selected from 22*c* the rotary drive is solely controlled by the output of the rotation sensor 19 on the rotary drive. The inputs to the drive control circuitry as shown comprise the outputs of the sensing means 16*b*, 17, 18, and 19 and the drive reference control C. When the input to the motor drive circuitry is selected from 22*b* the drive control circuitry is active in control of the rotary drive unless such control is disabled by control 32 opening the switch 32*a*. When the drive control circuitry is operative, various options are available. If, for example, the drive control reference signal is zero and the drive control circuitry connects the output of sensing means A2 18 to output, the motor 13 will be driven until the output of A2 is zero. In one embodiment of A2, its input axis of sensitivity is normal to the borehole axis 20 and thus the rotary drive will turn about the axis 20 until the sensitive axis of A2 is in the horizontal plane. Similarly, when the output of sensing means A1 is connected to the output of the drive control circuitry, the drive operates to null the output of A1. With a drive control reference input at C, either A2 or A1 as described above is driven so as to match their output to the reference input. Thus any orientation desired about the borehole axis can be obtained. Such modes as just described are used in the high speed survey mode for this class of tool and may be used as desired during steering operations that are the subject of this invention. If the drive control reference is a series of commands representing successive angular rotation positions and the drive control circuitry compares these to the output of the rotation sensor 19 to generate the output command, the rotary drive will execute a series of rotation positions following the reference input. This mode is typical of the gyrocompassing mode of the survey tool that is used to initialize the high speed survey mode. This mode is also used in a continuous cyclical mode to develop steering commands for drill steering when the borehole is near vertical. If the inertial angular rate sensing means 16*b* as shown has one of its axes of sensitivity along the borehole axis 20, then the drive control circuitry may select that input to compare to a drive control reference input and thus stabilize the rotary drive to follow said input command in inertial space. Further, if the output of the drive control circuitry is disabled as by opening switch 32*a*, then the rotary drive remains fixed in relation to the outer structure of the survey tool. In this mode, useful information for survey and steering may be obtained from the outputs of A1, A2, G1, and G2. The detail choice of the exact mechanization is determined by surface data processing equipment that can direct the selection of modes of operation by the downward transmission of commands to the control circuitry.

In the method of this invention, the steering of drilling is accomplished by installation of the sensor assembly 10 into the bottom hole assembly 40 before drilling is started. The wireline 12 is connected through the side entry subassembly. At the start of the hole, the bent subassembly 27 is replaced by a straight assembly if the initial portion of the borehole is to be vertical instead of building inclination. Initial measurements of azimuthal direction, inclination, gyro tool face and highside toolface are made by rotation of the sensors about the borehole axis using the rotary drive assembly. These measurements are free of bias type errors in the sensors since the rotation of the sensors causes cancellation of such errors. These initial measurements constitute a first survey point to establish the initial conditions for the first steering segment. When mud flow is initiated, the mud motor 28 drives (i.e. rotates) the drill bit 29 which then causes the entire bottom hole assembly and the drill pipe above it to descend into the earth. The sensor assembly continues to operate so as to rotate (via motor M, 13) the sensors about the borehole axis. From the outputs of the sensors, the same borehole axis. From the outputs of the sensors, the same parameters of azimuthal direction, inclination, gyro tool face, and high side tool face are computed as drilling progresses. Generally, in the initial phases of drilling, only inclination and high side tool face are useful, since in a vertical section, azimuthal direction is undefined.

Each time the drill bit has penetrated a distance equivalent to one section of drill pipe, the mud flow is stopped so that another section of drill pipe can be added to the string. During this period, the sensor assembly continues to operate to produce data, and the reduced vibration environment with drilling stopped leads to higher accuracy in the measured data. This data may then be combined with the known length of drill pipe in the hole (known by measurement of the length of drill pipe segments used or by length of the wireline in the hole) to compute a survey station position. Thus one set of equipment is employed to initially survey the starting orientation, to steer the drilling until a new section of drill pipe is required, and to survey the point in space reached by the bottom hole assembly at the time and depth of the addition of each drill pipe segment. Substantial savings in time and cost are thus achieved by this present method.

If the initial portion of the hole has been drilled vertical using a straight subassembly, the drilling process may be interrupted when it is desired to deviate the hole from vertical so that a bent subassembly may be installed by pulling the bottom hole assembly. If so, drilling may resume when the bottom hole assembly is returned to the bottom of the hole. Steering in the desired direction can then be accomplished by rotating the total drill string so that the desired tool face direction is achieved. The actual tool face as determined by sensor measurements is presented to the driller on the driller's display unit 100. The driller then rotates the entire drill string until the actual tool face is in the desired direction to cause the drill to progress in that direction.

When the inclination of the borehole has reached a few degrees, a survey tool of the form shown in FIG. 5(*a*) may be operated in an improved mode. The rotation axis may be stabilized using the output of the acceleration sensor A2, 18 so as to maintain it's sensitive axis horizontal in a fixed relation to the earth. In this condition, changes in azimuthal direction may be observed by monitoring the integrated output of inertial angular rate sensing means G1 16, the inclination angle may be observed by monitoring the average value of inertial acceleration sensing means A1 17, and the high side tool face may be observed by monitoring the output of the rotation sensor R 19. Steering can thus be provided based on high side tool face readings that are continuous in nature. Further, in this mode, when drilling is stopped to add a new section of drill pipe, the drill string may be pulled back to a point equivalent to the last point of adding pipe and then, as the drill string is lowered again into the borehole to resume drilling, the borehole segment may be accurately surveyed in a high speed survey mode using the known azimuthal direction and inclination at the previous point as initial conditions. Thus the accuracy benefits of high speed surveying can be extended, one segment at a time, to the full extent of drilling, using this steering method.

The method of drill steering with attendant survey accomplishment described above may be continued throughout the complete drilling activity until the final target location is reached. However, once the drilling has progressed to a point where magnetic interference is reduced to an acceptable level, the previous methods of steering using magnetometer-based steering tools, if desired, can be used.

Alternatives to the details of operation of the sensor assembly presented above may be employed in some cases. After the initialization at the start of the borehole, the sensors may be stabilized in a fixed orientation with respect to the bottom hole assembly by stabilizing the rotary drive to the output of the rotation sensor R, 19 during drilling. In this configuration, a continuous indication of inclination and high side tool face may be computed from the outputs of acceleration sensing means A1 17 and A2 18. This provides a higher data rate for the output information but does not provide data on azimuthal direction or gyro tool face. This mode is useful both in the vertical section of the borehole as well as when inclination increases. As in the previous method, survey data may be measured as each section of drill pipe is added, either by cyclical rotation of the sensors as described for gyrocompass measurements or by withdrawing the bottom hole assembly to a previously surveyed station and then using the high speed surveying technique as the drill pipe and bottom hole assembly are dropped back to the bottom of the borehole.

As a further alternative, survey tools of the form of FIGS. 5(*a*) and 5(*b*) that have an inertial angular rate sensing axis along the direction of the borehole may stabilize the rotary drive about the borehole axis with respect to inertial space by connecting the output of such a sensor to the drive control circuitry as described in connection with FIG. 6. In this mode steering information useful in both the vertical and inclined sections may be obtained. In this configuration, both gyro tool face and high side tool face can be obtained. The gyro tool face is measured by the rotation sensor R 19 and the high side tool face is again obtained from sensors A1 17 and A2 18.

The choice of exact configuration of the sensors and the rotary drive for any specific steering application depends on the circumstances pertaining to each particular application. These selections are made for each portion of each drilling job to obtain acceptable accuracy in the least amount of time and at the lowest cost. The application flexibility of the methods of this invention is far greater than any previous steering method.

Although the previously described methods provide a general description of the invention it is clear that many changes can be made in the details of operation without departing from the spirit and scope of this disclosure. Therefore, it is to be understood that the invention is not limited to the embodiment set forth herein for the purposes of example, but is to be limited only by the scope of the attached claims, including a full range of equivalents to which each element thereof is entitled.

Referring to 7, a mud driven motor 28*a* is in unit 28, as in FIG. 2. Mud passes down to the motor within passage 25 in pipe lengths 9, and passage 27*a* with 27. A drill mud supply at the surface is indicated at 125. A rotary table 126 at the surface is operable to rotate the drill string. Sections of drill pipe are made up at threaded joints 9*a*.

FIGS. 1, 2, 5*a*, 5*b*, have been labeled "PRIOR ART" to indicate that at least portions of same illustrated prior art equipment.

We claim:

1. In a wellbore steering method incorporating a bottom hole drilling assembly including drilling mechanism, for measuring the path of the drilling mechanism as it penetrates the earth, and which employs first sensing means for sensing inertial angular rate, and second sensing means for sensing inertial acceleration or tilt of the assembly in the borehole, said first and second means having sensitive axes and outputs and a rotary drive for said first and second means, said rotary drive means having drive means and rotation angle sensor means, and circuitry for processing said outputs and for controlling said rotary drive, the steps that include:

(a) operating the drive and the first and second means at a first location in the borehole, proximate the drilling mechanism, (b) and also operating said circuitry to produce signals used to determine the azimuthal direction of tilt, the tilt or inclination angle, and the tool face direction of the bottom hole drilling assembly.

2. The method of claim 1 including continuing the operation of the drive and the first and second means and said circuitry to produce signals used to continuously determine said azimuthal direction, tilt, and tool face direction as the drill assembly penetrates further into the earth from said first location.

3. The method of claim 1 includng transmitting signals corresponding to said tool face direction to a display for the drill operator for use in controlling the direction in which the borehole is steered.

4. The method of claim 2 in which the continuous determination of said azimuthal direction, tilt, and tool face direction is accomplished by continued rotation of first and second means to successive angular orientations about the borehole axis.

5. The mthod of claim 4 in which said tool face direction is determined and is the high side tool face direction.

6. The method of claim 4 in which said first means includes a gyro and said tool face direction is determined and is the gyro tool face direction.

7. The method of claim 2 in which the borehole has an axis and the rotary drive has an axis, and the continuous determination of said tool face direction is accomplished by stabilization of said rotary drive into a specific orientation about the borehole axis by operating the rotary drive in feedback relation with either first or second said sensing means or a drive rotation sensor on the drive axis.

8. The method of claim 7 in which the second sensor means has two axes of sensitivity, the rotary drive being stabilized to maintain one of the said axes of sensitivity of said second sensor means at a predetermined orientation relative to horizontal during said continuous operation, so as to determine the high side tool face direction directly from said drive rotation sensor.

9. The method of claim 7 in which the rotary drive is stabilized using the one of the outputs of said first sensor means to maintain the first and second sensor means in a predetermined orientation with respect to inertial space so as to determine both high side tool face from said second sensor means and gyro tool face from said drive rotation sensor.

10. In the methods of one of claims 4, 5 and 6, the additional step:

(d) computing from the measurements made for steering the drill path and from an additional measure of the length along the borehole from the surface to the drill bit, survey parameters of drill position in both horizontal and vertical components with relation to the start position of the borehole.

11. In the method of claim 7 the additional steps:

(d) computing from the measurements made for steering the drill path and from an additional measure of the length along the borehole from the surface to the drill bit, survey parameters of drill position in both horizontal and vertical components with relation to the start position of the borehole, (e) improving the accuracy of said survey computation by periodically pulling the drill string back out of the borehole a distance necessary to reach a previous accurate point and then rapidly returning the drill string to the bottom position.

12. The method of claim 1 wherein a drill string extends in the borehole above said bottom hole drilling assembly, and is connected thereto, and including transmitting data corresponding to said outputs to the surface via a wire line provided in the borehole and outside the drill string.

13. The method of claim 12 including connecting sections of said drill string in end-to-end series while also continuing said data transmission via said wire line.

14. The method of claim 1 including monitoring tool face direction by employing data derived from said second sensing means.

15. The method of claim 13 including employing downward mud flow in the borehole to drive said drilling mechanism, and stopping said mud flow during connection of said pipe sections, but continuing to transmit said data via said wire line which extends in mud in the borehole, outside the drill string.

16. In a wellbore steering method incorporating a downhole assembly including a drill tool that penetrates the earth formation along a drilling path, and a rotatable drill string extending downwardly in the wellbore to said assembly, said assembly including first sensing means for sensing inertial angular rate, and second sensing means for sensing inertial acceleration or tilt, of the assembly in the borehole, said first and second means having sensitive axes and outputs and a rotary drive for said first and second means, said rotary drive having drive means and rotation angle sensor means, and circuitry for processing said outputs and for controlling said rotary drive, the steps that include (a) forcing drilling mud down the drill string to said assembly to operate the drill tool, (b) monitoring the azimuthal direction, tilt angle and tool face direction of the assembly as drilling progresses, by operation of said drive, said first and second means and said circuitry, (c) and controllably rotating the string in response to said monitoring.

17. The method of claim 16 wherein said monitoring includes providing a display at the well surface, generating signals at the downhole assembly corresponding to said tool face direction, and transmitting said signals to the display.

18. The method of claim 17 wherein said transmitting includes providing a signal transmission wireline in the wellbore outside the drill string, and employing said wireline to transmit said signals.

19. The method of claim 18 including adding sections of drill pipe to the drill string as drilling progresses, without disrupting said wireline.

20. In a wellbore steering method incorporating a downhole drilling assembly including a drill tool that penetrates the earth formation along a drilling path, and a rotatable drill string extending downwardly in the wellbore to said assembly, the steps that include (a) forcing drilling mud down the drill string to said assembly to operate the drill tool, (b) monitoring the azimuthal direction, tilt angle and tool face direction of the assembly as drilling progresses, (c) and controllably rotating the string in response to said monitoring and wherein said tool face direction is an angle defined as $$\text{ARCTAN}\ \frac{[\text{Sin}(\psi)\ {}^{*}\text{Cos}(HS){}^{*}\text{Cos}(\theta) + \text{Cos}(\psi){}^{*}\text{Sin}(HS)]}{[\text{Cos}(\psi)\ {}^{*}\text{Cos}(HS){}^{*}\text{Cos}(\theta) - \text{Sin}(\psi){}^{*}\text{Sin}(HS)]}$$

where $\psi$ is a rotation about the Z axis of an XYZ coordinate set where

X is north directed

Y is east directed

Z is down directed, and HS is a rotation of the set about the resultant X axis after the set has been further rotated through an angle $\theta$ about the Y axis.

21. The method of claim 16 wherein said tool face direction is an angle approximately defined as $$\psi + HS$$

where $\psi$ is a rotation about the Z axis of an XYZ coordinate set where

X is north directed

Y is east directed

Z is down directed, and HS is a rotation of the set about the resultant X axis after the set has been further rotated through an angle $\theta$ about the Y axis.

* * * * *